United States Patent [19]

Houle

[11] Patent Number: 4,702,609

[45] Date of Patent: Oct. 27, 1987

[54] APPARATUS FOR MIXING ANIMAL FEED MATERIALS

[75] Inventor: Mario Houle, Wickham, Canada

[73] Assignee: Agrimetal Inc., Wickham, Canada

[21] Appl. No.: 907,750

[22] Filed: Sep. 16, 1986

[51] Int. Cl.[4] ..... B01F 15/02

[52] U.S. Cl. ..... 366/184; 198/443; 366/271; 414/304

[58] Field of Search ..... 366/603, 184, 186, 192, 366/194, 195, 196, 241, 255, 271, 348, 349, 346, 343, 345; 414/304; 198/443, 397

[56] References Cited

U.S. PATENT DOCUMENTS

| | | | |
|---|---|---|---|
| 2,920,743 | 1/1960 | Fradenburgh | 198/443 |
| 3,345,042 | 10/1967 | Ryan | 366/603 |
| 3,412,982 | 11/1968 | Feterl | 366/603 |
| 3,692,282 | 9/1972 | Niblo | 366/271 |

*Primary Examiner*—Robert W. Jenkins

*Attorney, Agent, or Firm*—Robic, Robic & Associates

[57] ABSTRACT

An apparatus for mixing materials for making animal feed, comprising a mixer including a pair of endless chains interconnected by parallel mixing members spaced from one another and forming a travelling endless conveyor. The chains are supported solely by two pairs of upper sprocket wheels, one of which is a driving pair. The length of the chains is selected so that the belt has a lower arcuate strand below the sprocket wheels and a substantially linear upper strand in between the sprocket wheels, the lower strand being longer than the upper one, both of these strands defining an inner mixing zone. The mixer is mounted in an open-top casing having an arcuate bottom beneath and adjacent to the lower strand and a linear strand between the sprocket wheels. A rotary lump breaking member is provided in the mixing zone close to an parallel to the mixing members, in front of a mixture discharge opening provided in the casing.

13 Claims, 9 Drawing Figures

Fig. 6a
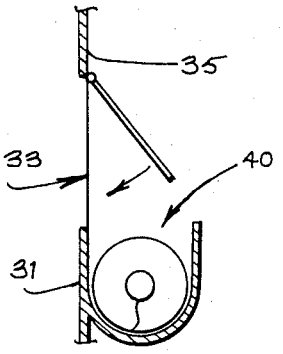
Fig. 6b
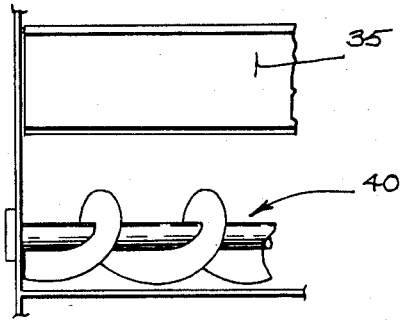
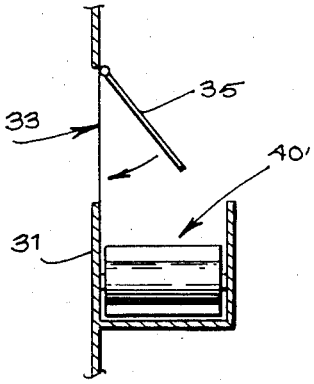
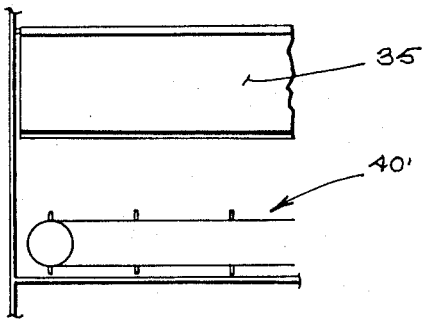
Fig. 7a
Fig. 7b
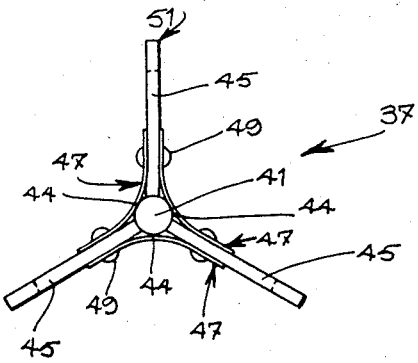
Fig. 5

APPARATUS FOR MIXING ANIMAL FEED MATERIALS

FIELD OF THE INVENTION

The present invention relates to an apparatus for mixing sundry materials and, especially, for preparing animal feeds including ensilage mixes, fodder, ground corn, grains, minerals, medicaments, etc., and also including straw and hay.

SUMMARY OF THE INVENTION

A main object to the invention lies in providing a generally half-cylindrical drum-like mixer for the above purposes which is simple and sturdy in construction while, due to its material handling principle based on continuous overthrow, provides mixtures that are continuously homogenous as they come out of the discharge opening.

This is particularly due to the fact that the apparatus comprises an endless travelling conveyor including a plurality of transverse elongated parallel material-mixing members which define an inner mixing zone, the mixing members being spaced from one another to allow feeding of materials to be mixed into the zone, each mixing member having a mixing blade which is turned inward into the chamber for causing proper mixing of the materials fed thereinto. This endless travelling conveyor is so supported that it defines a lower strand and a substantially linear upper strand, the lower strand being substantially longer than the upper strand and the two defining the mixing zone. The conveyor is mounted in a casing having an open top which allows appropriate feeding of materials into the mixing zone through the spaces between the mixing members of the upper strand. The casing also has side and bottom walls which stand adjacent the lower strand and outwardly with respect to the mixing zone.

The apparatus according to the invention may further and advantageously be provided with a lump breaking rotary member located close to the conveyor to break up lumps that may have formed during overthrowing of the materials, particularly loosening away hay or straw that may have clung to the inner edges of the mixing blades. The lump breaking member is advantageously located in facing relation with the discharge opening to thus force such hay and/or straw out through the opening along with the remaining materials.

A description now follows of a preferred embodiment having reference to the appended drawings.

BRIEF DESCRIPTION OF THE DRAWINGS

FIG. 5 is an end view of the rotary lump breaking member shown in FIG. 4;

FIGS. 6*a* and 6*b* are end and partial front views of another material discharge assembly usable in a mixing apparatus as shown in FIGS. 1 to 3; and FIG. 7*a* and 7*b* are end and partial front views of a further material discharge assembly usable in a mixing apparatus as shown in FIGS. 1 to 3.

DESCRIPTION OF A PREFERRED EMBODIMENT

Figure 1:
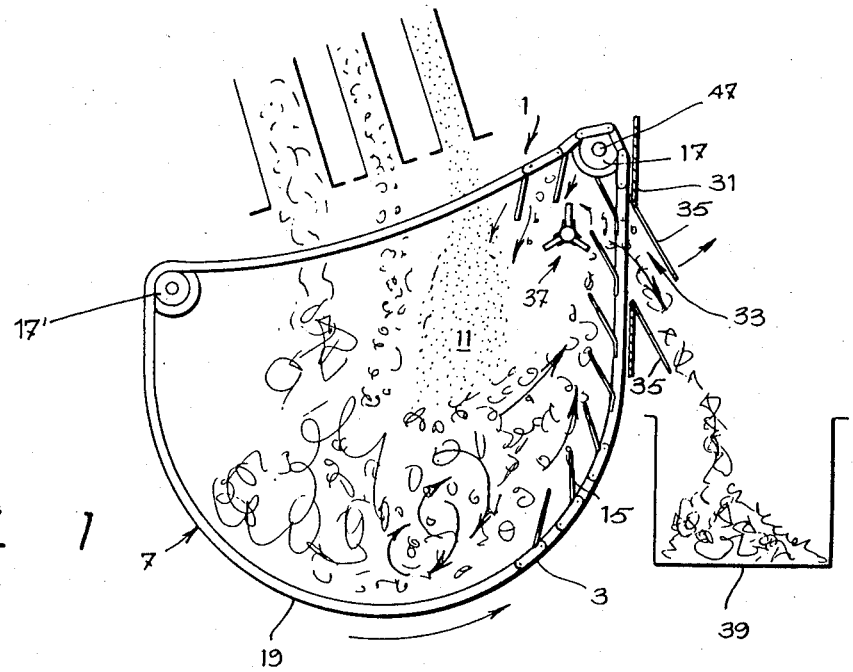
FIG. 1 is a diagrammatic end view of a material mixing endless conveyor and of a first material discharge assembly for use in a mixing apparatus according to the invention.
Figure 2:
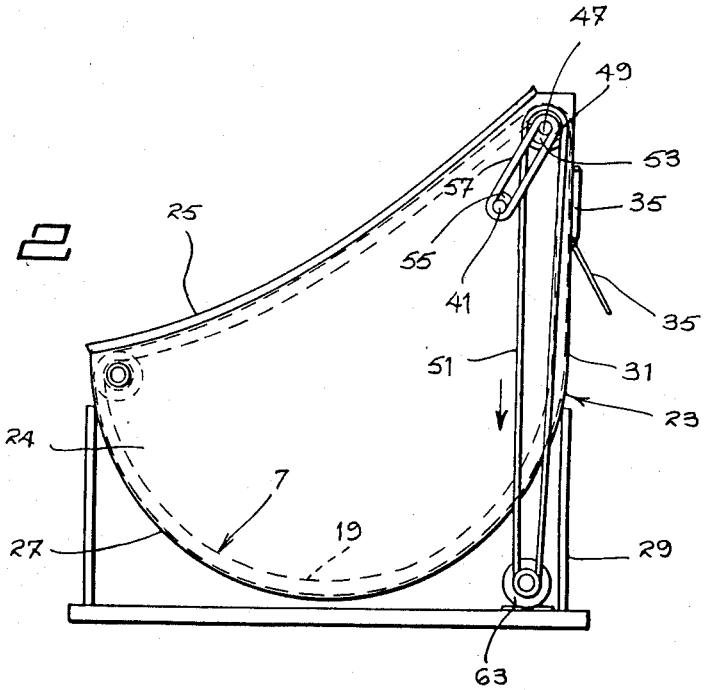
FIG. 2 is an end view of the whole mixing apparatus.
Figure 3:
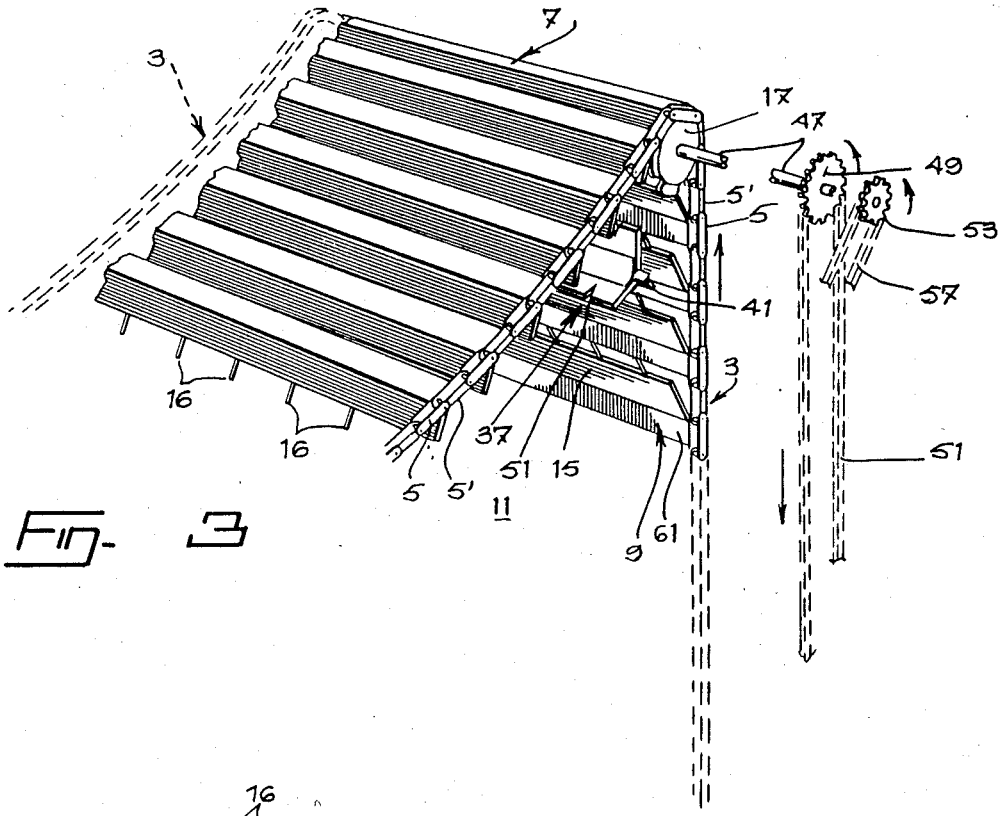
FIG. 3 is a perspective view of a portion of the endless travelling belt, the lump breaking member and part of the driving mechanism.
Figure 4:
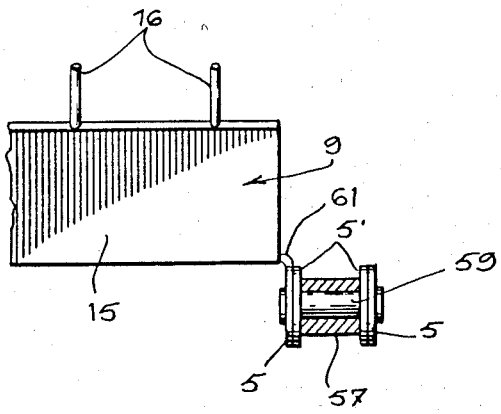
FIG. 4 is a side elevation view of a mixing member shown secured to one of the endless chains.

The mixing apparatus according to the invention as shown in FIGS. 1, 2 and 3, basically comprises a material mixing endless conveyor 1 comprising a pair of spaced parallel endless chains 3 each having an equal number of successive links 5, 5' connected end to end, the links of one chain pairing with the links of the other chain. The travelling conveyor 1 has a travelling belt 7 formed of elongated parallel material-mixing members 9 extending transversely between the chains 3 and altogether defining an inner mixing zone 11 clearly visible in FIG. 1. As best shown in FIG. 3, the mixing members 9 are spaced from one another so as to allow feeding therebetween of materials to be mixed into the mixing zone 11. The feeding may be through any conventional feed hoppers 13 has shown in FIG. 1, each hopper carrying one particular material. As clearly apparent in FIGS. 1 and 3, the mixing members 9 each have an angularly extending mixing blade 15 whose outer edge is extended outwardly by plurality of regularly spaced-apart pins 16. Means, to be more fully described hereinafter, mount the ends of each mixing member 9 to one pair of links 5 of the endless chains 3, with its mixing blade 15 turned into the mixing zone 11 so as to cause mixing of the materials fed into the said zone 11. This is clearly illustrated in FIGS. 1, 3 and 4.

Two pairs of sprocket wheels 17, 17', the chains 3 wind over which are provided at the upper end of the mixing zone 11. The sprocket wheels 17, 17' thus support and drive the chains along with the mixing members 9 into endless travel. Particularly from FIG. 1, it will be noted that the pairs of sprocket wheels 17, 17' constitute the sole support for the chains 3 and mixing members 9. Additionally, referring particularly to FIG. 1, it is seen that the chains 3 have a preselected length and are so disposed over the sprocket wheels 17, 17', that the travelling belt 7 defines a lower arcuate strand 19 hanging from beneath the sprocket wheels 17, 17', and a substantially linear but shorter upper strand 21 extending between and over the sprocket wheels 17, 17'.

The above described endless conveyor 1 is mounted, in any known manner, in a casing 23 having an open top 25 for feeding materials into the mixing zone 11 through the spaces between the mixing members 9 of the upper strand 21, as mentioned above. The casing 25 also has an arcuate bottom 27 which is located beneath and close to the lower arcuate strand 19. The casing 23 is mounted on a frame 29 which may be stationary or wheel mounted. The casing 23 thus has an essentially half-cylindrical shape with the open top extending fully lengthwise, thus providing for extremely easy and efficient insertion into the mixing zone 11 of the various materials to be mixed and introduced by means of the hoppers 13. The casing 23 and the inner mixing zone 11 are closed at their common ends by essentially half-cylindrical flat upward walls 24 (FIG. 2).

As shown also in FIG. 2, one side of the arcuate bottom (or sidewall) 27 of the casing 23 extends upwardly to a certain extent into a vertical linear discharge wall 31 through which is defined a discharge opening 33 for the mixed materials. The opening 33 is located under the sprocket wheels 17 and is closable in any known manner by a hinged door 35 of which the opening, closing and locking movements may be obtained by means of any conventional mechanism.

According to a first embodiment shown in FIGS. 1 and 2 exclusively, the discharge opening 33 in the vertical wall 31 may be provided with a slanted chute 36 for guiding the mixed materials into a container 39. Alternatively, the opening 33 may positioned over a transversal endless screw conveyor 40 (see FIGS. 6*a* or 6*b*) or a transversal endless belt conveyor 40' (see FIGS. 7*a* and 7*b*) for transporting the mixed materials exiting the opening 33 to another place. Referring again to FIG. 1, the mixing apparatus according to the invention further comprises a rotary lump breaking member 37 which is parallel to and adjacent the mixing blades 15 and is also adjacent as well as in facing relation with the discharge opening 33. As mentioned previously, the materials used for preparing the animal feed may and usually include pieces of straw and hay that have a tendency, particularly when moist, to clung to the free edges of the mixing blades 15 and to the pins 16. It will be noted from the arrows in FIGS. 1 and 3 that the travelling belt 7 and the lump breaking member 37 rotate in opposite directions which is efficient not only for dislodging any hanging pieces of hay and/or straw, breaking any lumps that may have formed, but also for forcably driving the mixed materials through the discharge opening 33 which faces the breaking member 17.

Referring to FIGS. 3 and 5, the rotary lump breaking member 37 which, as said before, is located in facing relation with the discharge opening 33, comprises a central shaft 41 on which are mounted at least two and preferably three elongated slots 45 made of resitient material like rubber. The slots 45 are equally spaced apart and extend radially from the shaft 41. Such a positioning is achieved with three arcuate members 43 made of sheet metal, which are welded onto the shaft (at 44) in such a manner as to define three radial slots 47 in which the slots 45 are engaged and held by means of rivets 49. The lump breaking member 37 is located within the inner mixing zone 11 in such a manner that the free edges of the elongated slots 45 are tangent with the outer edges of the successive mixing blades 15, whereby, in use, rotation of the lump breaking member causes the slots 45 to break the lumps and dislodge the pieces of hay and straw that may cling onto the mixing blades 15 and their associated pins 16. Slots 51 are provided for into the free edges of each slot 45 to give room to the pins 16 and thus prevent early wearing of the slots 45 in use.

FIG. 1 shows that the sprocket wheels 17 stands at a higher level than the sprocket wheels 17' so that the substantially linear upper strand 21 of the travelling belt 7 is appreciably inclined between the wheels 17, 17'. It has been found that with counterclockwise rotation of the travelling belt 7, the inclination of the upper strand 21 (which acts as a grate through which pass the materials from the feed hoppers) gives a better mixing effect.

The apparatus of course includes power means that simultaneously drive the sprocket wheels 17, through a common shaft 47, as well as the shaft 41 of the rotary lump breaking member 37. Such power means are shown to the right of FIG. 3. For this purpose, the shaft 47 is provided at one end with a driving sprocket wheel 49 driven by a chain 51 which is energized by a motor 63 mounted at the base of the frame 29.

The shaft 47 transmits its rotational motion to the drive shaft 41 of the lump breaking member 37 by means of a pair of sproket wheels 53 and 55 that are respectively fixed to the shafts 47 and 41 and mechanically connected by a chain 57. The arrows show that counterclockwise rotation of the chain 51 causes the travelling belt 7 and the lump breaking member 37 both to move counterclockwise.

Each endless chain 3 is of conventional construction, being made of links that come in successive pairs, that is a pair of outer links 5 and a pair of inner links 5'. The inner links 5' take the form of two spaced parallel cheeks that are inwardly connected at their ends by short hollow cylinders 57 and are formed with holes that register with the bores of the cylinders 57. The outer links 5 are merely spaced parallel cheeks having holes at their ends in alignment with the bores of the short cylinders 57. Pivot pins 59 extend across the cylinders and the inner and outer cheeks to allow the links to wind around the sprocket wheels 17, 17'. Every cheek 5, located inwardly with respect to chamber 11, is constituted by a downwardly bent end of a securing blade 61, integral with a mixing blade 15. The blades 15 and 61 together form an angular mixing member 9 defining an obtuse angle therebetween, as best illustrated in FIG. 3.

Advantageously, the diameter of the driving sprocket wheel 49 at the right of FIG. 3, is much larger than that of the sprocket wheel 53 driving the lump breaking member 37 so that the later rotates at a much faster speed than the sprocket wheels 17, 17'. Indeed, there is a great advantage in having the breaking member 37 rotating at a faster speed than the linear speed of the travelling belt 7, to "lift" the lumps and pieces of hay and straw attached to the pins and let them fall down through the opening 33.

In use, the mixing endless conveyor 1 is driven for a given period of time with the opening 33 being closed by the door 35, to cause the material fed into the mixing zone 11 to intimately mix. In this connection, the blades 15 and pins 16 causes the material to be mixed to move up and fall down in the mixing zone a plurality of times thereby mixing excellent. Whenever desired, the door 35 may be opened, thereby allowing the material to be discharged through the opening 33 thanks to the downwardly inclined positon of the blades 15 and to the action of the lump breaking member 37.

It is with noting that the chain-supporting sprocket wheels 17, 17' are never in contact with the material to be mixed, and to their particular upper position, thereby substantially reducing the maintenance problem and risk of contamination of the feed with lubricant.

I claim:

1. An apparatus for mixing materials for making animal feed, said apparatus comprising:

a material mixing endless conveyor displaceable in a predetermined direction, said conveyor comprising an endless travelling belt including a plurality of elongated parallel material-mixing members extending transversely of said predetermined direction and defining an inner mixing zone, said mixing members being spaced from one another to allow feeding of materials to be mixed into said chamber, each of said mixing members having a mixing blade turned into said mixing zone for causing mixing of materials fed thereinto;

a casing;

means for mounting and supporting said endless belt and said casing at two spaced locations so that said belt defines a lower strand beneath said locations and a substantially linear upper strand between said locations, said lower strand being substantially longer than said upper strand and said strands delimiting said mixing zone said casing having an open top for feeding materials into said mixing zone through said spaces between said mixing members of said upper strand, said casing also having a bottom wall adjacent said lower strand, outwardly thereof with respect to said lower strand, outwardly thereof with respect to said zone, over which said lower strand moves along, and at least one vertical side wall; and door means on said at least one vertical side wall of the casing for the discharge of mixed materials, said door means defining a discharge opening adjacent said upper strand for the egress of mixed materials.

2. An apparatus as claimed in claim 1, further comprising:

a rotary lump breaking member and means for mounting said breaking member within said mixing zone parallel to and adjacent said mixing blades and said discharge opening.

3. An apparatus as claimed in claim 2, wherein said rotary lump breaking member comprises a plurality of elongated slots mounted onto a shaft parallel to said mixing blades, and means for causing rotation of said shaft and slots.

4. An apparatus as claimed in claim 3, wherein said slots are made of resilient material.

5. An apparatus as claimed in claim 4, wherein each of said mixing blade is provided with a plurality of outwardly extending pins and said slots are provided with slots for giving room to said pins.

6. An apparatus for mixing materials for making animal feed, said apparatus comprising:

A:a material mixing endless travelling conveyor comprising:

a pair of spaced parallel endless chains, said chains having an equal number of successive links connected end-to-end with a link of one of said chains pairing with a link of the other chain;

elongated parallel material-mixing members extending transversely between said chains to form an endless travelling belt defining an inner mixing zone, said mixing members being spaced from one another to allow feeding of materials to be mixed into said zone, each of said mixing members having a mixing blade;

means for mounting the ends of each mixing member to one pair of said links with the mixing blade thereof turned into said mixing zone for causing mixing of materials fed thereinto;

two pairs of sprocket wheels, at the upper end of said mixing zone, over which said chains wind thereby supporting and driving said chains and mixing members, said sprocket wheels constituting sole supports for said chains and mixing members; said chains having a preselected length and being so disposed over said sprocket wheels that said travelling belt defines a lower arcuate strand hanging from beneath said sprocket wheels and a substantially linear upper strand extending between and over said sprocket wheels, said lower strand being substantially longer than said upper strand and said strands delimiting said inner chamber;

B: a casing and means for mounting said endless conveyor in said casing, said casing having an open top for feeding materials into said mixing zone through said spaces between said mixing members of said upper stand and having an arcuate bottom beneath said arcuate strand, one side of said arcuate bottom of said casing extending upwardly into a discharge wall;

C: openable door means on said discharge wall, said door means defining a discharge opening adjacent one of said pairs of sprocket wheels for the egress of mixed materials; and D: a rotary lump breaking member mounted within said mixing zone parallel to and adjacent said mixing blades and said discharge opening.

7. An apparatus as claimed in claim 6, wherein said rotary lump breaking member comprises a plurality of elongated slots mounted on a shaft parallel to said mixing blades, and means for causing rotation of said shaft and slots at a speed higher than the speed of said mixing blades.

8. An apparatus as claimed in claim 7, wherein said one of said pairs of sprocket wheels is located over said discharge opening at a level higher than the level of the other pair of sprocket wheels whereby said linear strand is inclined between said pairs of sprocket wheels.

9. An apparatus as claimed in claim 8, including power means simultaneously driving said one pair of said sprocket wheels, located adjacent said discharge opening, and said lump breaking member.

10. An apparatus as claimed in claim 9, wherein said slots of said lump breaking member are made of resilient material.

11. An apparatus as claimed in claim 10, wherein:

said links of said chains comprise inner cheeks with respect to said zone;

said mixing members are angular members comprising said mixing blades and securing blades; and said securing blades have bent ends acting as said inner cheeks of said chain inner cheeks.

12. An apparatus as claimed in claim 11, wherein each of said mixing blades are provided with a plurality of outwardly extending pins and said slots are provided with slots for giring room to said pins.

13. An apparatus as claimed in claim 12, wherein said open top extends essentially the full length of said casing.

* * * * *